US011561496B1

(12) United States Patent
Kurita

(10) Patent No.: US 11,561,496 B1
(45) Date of Patent: Jan. 24, 2023

(54) IMAGE FORMING APPARATUS

(71) Applicant: TOSHIBA TEC KABUSHIKI KAISHA, Tokyo (JP)

(72) Inventor: Suguru Kurita, Sunto Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/570,401

(22) Filed: Jan. 7, 2022

(51) Int. Cl.
*G03G 15/00* (2006.01)

(52) U.S. Cl.
CPC ..... *G03G 15/5058* (2013.01)

(58) Field of Classification Search
CPC ..... G03G 15/5041; G03G 15/5054; G03G 15/5058; G03G 15/5062; G03G 2215/00029; G03G 2215/00033; G03G 2215/00037; G03G 2215/00042
See application file for complete search history.

(56) References Cited

U.S. PATENT DOCUMENTS

| | | | | |
|---|---|---|---|---|
| 6,515,769 | B1 | 2/2003 | Ikeda et al. | |
| 2004/0165025 | A1* | 8/2004 | Ishibashi | H04N 1/00087 347/19 |
| 2007/0003302 | A1* | 1/2007 | Mizes | G03G 15/5041 399/49 |
| 2008/0226316 | A1* | 9/2008 | Koshimura | G03G 15/5041 399/49 |
| 2010/0272455 | A1* | 10/2010 | Muramoto | G03G 15/50 399/66 |
| 2014/0168677 | A1* | 6/2014 | Mukaihara | G03G 15/55 358/1.9 |

FOREIGN PATENT DOCUMENTS

| | | | |
|---|---|---|---|
| JP | 2010-039071 | | 2/2010 |
| JP | 2011099940 A | * | 5/2011 |
| JP | 2014-135693 | | 7/2014 |
| JP | 2019-38220 | | 3/2019 |

OTHER PUBLICATIONS

Machine Translation of JP-2011099940-A. May 2011. (Year: 2011).*

* cited by examiner

*Primary Examiner* — Carla J Therrien
(74) *Attorney, Agent, or Firm* — Amin, Turocy & Watson, LLP

(57) ABSTRACT

An image forming apparatus includes a detection unit to detect a toner attached to an image carrying surface at a detection position. The first control unit controls the image forming unit such that a first check image including a patch pattern and a line pattern is formed. The relationship determination unit determines a correlation between a width of the line pattern and a density of an image to be formed based on a density of the patch pattern and a width of the line pattern. The determination unit determines an allowable range based on the determined correlation. The second control unit controls the image forming unit such that a second check image including the line pattern is formed. The line width determination unit determines a width of the line pattern based on a detection status relating to the line pattern. The monitoring unit monitors a formation status of the image by comparing the determined width and the determined allowable range.

20 Claims, 7 Drawing Sheets

IMAGE FORMING APPARATUS

FIELD

Embodiments described herein relate generally to an image forming apparatus and a method for an image forming apparatus.

BACKGROUND

In an electrophotographic image forming apparatus, if the formation density of an image increases, the width of a line to be formed increases. Therefore, a technique of monitoring the density of an image to be formed based on the width of a line pattern for check is proposed.

However, since a relationship between the width of a line and the density of an image is not uniform, it may be difficult to appropriately monitor the density of an image to be formed.

DETAILED DESCRIPTION

In general, according to one embodiment, an image forming apparatus includes an image carrier, an image forming unit, a transfer unit, a detection unit, a first control unit, a relationship determination unit, a determination unit, a second control unit, a line width determination unit, and a monitoring unit. The image carrier has an image carrying surface configured to move in a moving direction. The image forming unit is configured to form an image on the image carrying surface with toner at a formation position. The transfer unit is configured to transfer the image formed on the image carrying surface to a medium at a transfer position. The detection unit is configured to detect the toner attached to the image carrying surface at a detection position determined between the formation position and the transfer position. The first control unit is configured to control the image forming unit such that a first check image including a patch pattern and a line pattern that extends in a direction intersecting the moving direction is formed. The relationship determination unit is configured to determine a correlation between a width of the line pattern and a density of an image to be formed by the image forming unit based on a density of the patch pattern in the first check image and a width of the line pattern in the first check image. The determination unit is configured to determine an allowable range of the width of the line pattern based on the correlation determined by the relationship determination unit. The second control unit is configured to control the image forming unit such that a second check image including the line pattern is formed in a region that passes through the detection position in the image carrying surface. The line width determination unit is configured to determine a width of the line pattern in the second check image based on a detection status of the toner by the detection unit if the line pattern in the second check image passes through the detection position. The monitoring unit is configured to monitor a formation status of the image by the image forming unit by comparing the width determined by the line width determination unit and the allowable range determined by the determination unit.

Hereinafter, an embodiment will be described using the drawings. In the following embodiment, a multi-function peripheral (MFP) including an image forming apparatus as a printer will be described as an example. The content of various operations and processes described below is merely exemplary and, for example, change in the order of apart of the operations and the processes, omission of a part of the operations and the processes, or addition of another operation and another process can be appropriately made.

First, a configuration of the MFP according to the embodiment will be described.

Figure 1:
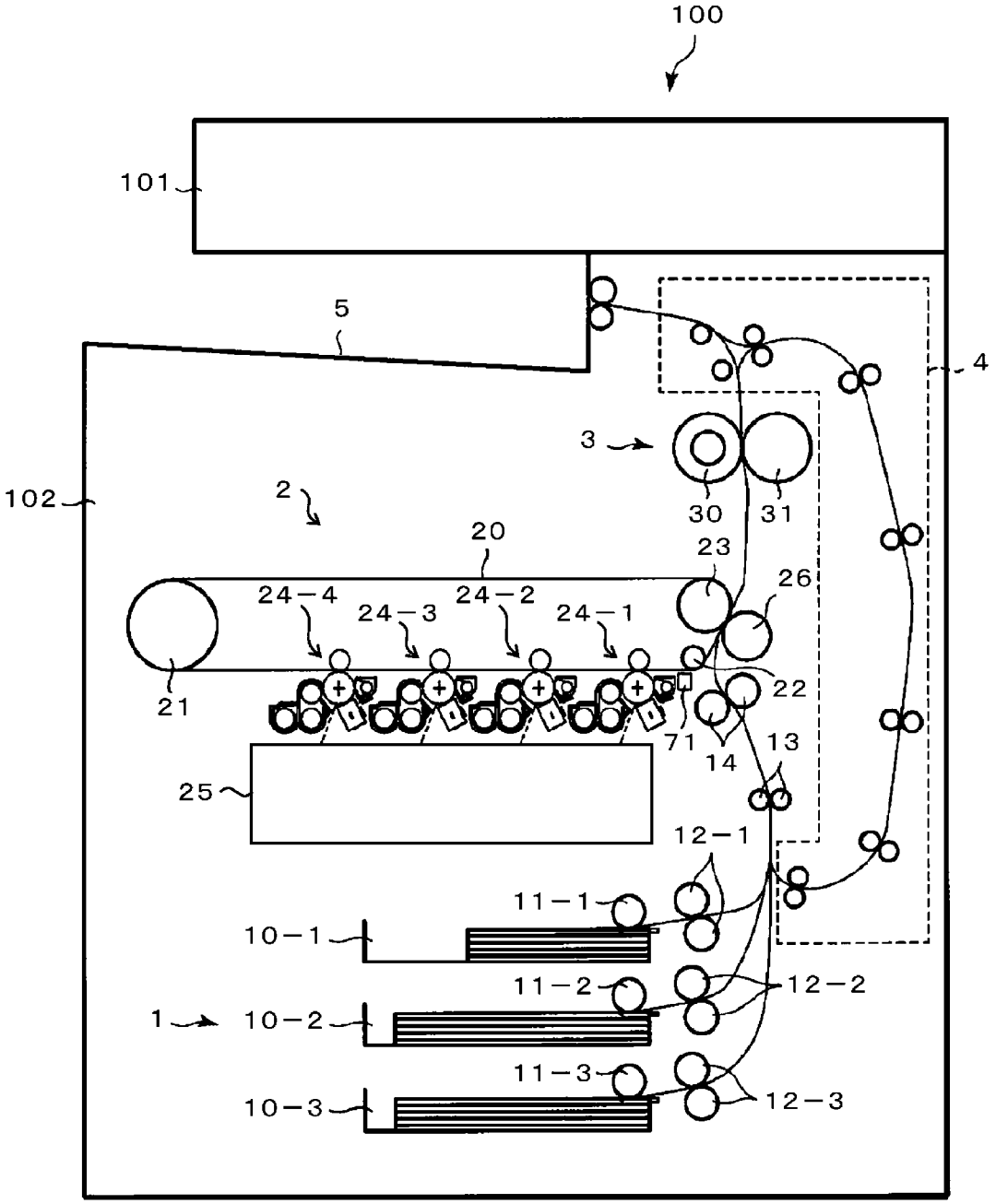
FIG. 1 is a diagram schematically illustrating a mechanical configuration of an MFP according to an embodiment.

FIG. 1 is a diagram schematically illustrating a mechanical configuration of an MFP 100 according to the embodiment.

As illustrated in FIG. 1, the MFP 100 includes a scanner 101 and a printer 102.

The scanner 101 reads an image of a document and generates image data corresponding to the image. For example, the scanner 101 generates image data corresponding to a reflected light image from a surface of a document to be read using an image sensor such as a charge-coupled device (CCD) line sensor. The scanner 101 scans a document placed on a document tray using an image sensor that moves along the document. Alternatively, the scanner 101 scans a document that is conveyed by an auto document feeder (ADF) using a fixed image sensor.

The printer 102 forms an image using an electrophotographic method on a medium on which an image is to be formed. Typically, the medium is print paper such as cut paper. Therefore, in the following description, print paper is used as the medium. As the medium, a sheet of another paper different from cut paper may be used, or a sheet of a material such as a resin other than paper may be used. The printer 102 has a color printing function of printing a color image on print paper and a monochrome printing function of printing a monochrome image on print paper. The printer 102 forms a color image by forming element images to overlap each other with, for example, toners of three colors including yellow, magenta, and cyan or four colors black in addition to the three colors. In addition, the printer 102 forms a monochrome image, for example, with black toner. The printer 102 may include only either one of the color printing function or the monochrome printing function.

In the configuration example illustrated in FIG. 1, the printer 102 includes a paper feed unit 1, a print engine 2, a fixing unit 3, an automatic double-sided unit (ADU) 4, and a paper discharge tray 5.

The paper feed unit 1 includes paper feed cassettes 10-1, 10-2, and 10-3, pickup rollers 11-1, 11-2, and 11-3, conveying rollers 12-1, 12-2, and 12-3, a conveying roller 13, and a registration roller 14.

The paper feed cassettes 10-1, 10-2, and 10-3 accommodate sheets of print paper in a state where the sheets are stacked. The sheets of print paper accommodated in the paper feed cassettes 10-1, 10-2, and 10-3 may be different types of sheets of print paper having different sizes and materials or may be the same type of print paper. In addition, the paper feed unit 1 may include a manual feed tray.

The pickup rollers 11-1, 11-2, and 11-3 pick up the print paper from each of the paper feed cassettes 10-1, 10-2, and 10-3 one by one. The pickup rollers 11-1, 11-2, and 11-3 supply the picked print paper to the conveying rollers 12-1, 12-2, and 12-3.

The conveying rollers 12-1, 12-2, and 12-3 supply the print paper supplied from the pickup rollers 11-1, 11-2, and 11-3 to the conveying roller 13 through a conveyance path formed by a guide member (not illustrated) or the like.

The conveying roller 13 further conveys and supplies the print paper supplied from any one of the conveying rollers 12-1, 12-2, and 12-3 to the registration roller 14.

The registration roller 14 corrects a tilt of the print paper. The registration roller 14 adjusts a timing at which the print paper is supplied to the print engine 2.

The paper feed cassettes, the pickup rollers, and the conveying rollers are not limited to three sets, and the number of sets may be freely set. In addition, if the manual feed tray is provided, it is not necessary to provide even one set including the paper feed cassette, the pickup roller, and the conveying roller, the paper feed cassette being paired with the pickup roller and the conveying roller.

The print engine 2 includes a belt 20, support rollers 21, 22, and 23, image forming units 24-1, 24-2, 24-3, and 24-4, an exposure unit 25, and a transfer roller 26.

The belt 20 has an endless shape and is supported by the support rollers 21, 22, and 23 to maintain the state illustrated in FIG. 1. The belt 20 rotates counterclockwise in FIG. 1 along with the rotation of the support roller 21. The belt 20 temporarily carries a toner image on a surface positioned on the outside (hereinafter, referred to as "image carrying surface"), the toner image being an image to be formed on the print paper. That is, the belt 20 is an example of the image carrier. From the viewpoints of heat resistance and wear resistance, for example, a semi-conductive polyimide is used as the belt 20. The image carrying surface moves along with the rotation of the belt 20 such that so-called sub-scanning is implemented, and a moving direction of the image carrying surface will also be referred to as "sub-scanning direction".

Each of the image forming units 24-1 to 24-4 includes a photoreceptor, a charging unit, a developing unit, a transfer roller, and a cleaner. Each of the image forming units 24-1 to 24-4 has a well-known structure for forming an image using an electrophotographic method in cooperation with the exposure unit 25. The image forming units 24-1 to 24-4 are arranged along the belt 20 in a state where axial directions of the photoreceptors thereof are parallel to each other. The image forming units 24-1 to 24-4 have the same structure and operation except that only the colors of the toners to be used are different from each other. The image forming unit 24-1 forms an element image, for example, with a black toner. The image forming unit 24-2 forms an element image, for example, with a cyan toner. The image forming unit 24-3 forms an element image, for example, with a magenta toner. The image forming unit 24-4 forms an element image, for example, with a yellow toner. Thus, each of the image forming units 24-1 to 24-4 is an example of the image forming unit. The image forming units 24-1 to 24-4 form the respective color element images to overlap each other on the image carrying surface of the belt 20. As a result, the image forming units 24-1 to 24-4 form a color image in which the respective element images overlap each other on the image carrying surface of the belt 20 if the image carrying surface passes through the image forming unit 24-1. Although not illustrated in the drawing, developer containers containing developers including the respective color toners are arranged, for example, in spaces above the belt 20. The developer may be a one-component developer consisting of only toner or may be a multi-component developer including not only toner but also another material such as a carrier.

The exposure unit 25 exposes the photoreceptor of each of the image forming units 24-1 to 24-4 in accordance with image data representing the respective color element images. As the exposure unit 25, for example, a laser scanner or a light emitting diode (LED) head is used. If the laser scanner is used, for example, the exposure unit 25 includes a semiconductor laser element, a polygon mirror, an imaging lens system, and a mirror. In this case, the exposure unit 25 selectively deflects, for example, a laser beam emitted from the semiconductor laser element in accordance with image data to the respective photoreceptors of the image forming units 24-1 to 24-4 by changing an emission direction from the mirror. In addition, the exposure unit 25 deflects the laser beam in the axial direction of the photoreceptor (a depth direction in FIG. 1) with the polygon mirror for scanning the photoreceptor. This scanning with the laser beam is a so-called main scanning, and the direction thereof will be referred to as "main scanning direction".

The transfer roller 26 is arranged parallel to the support roller 23, and the belt 20 is interposed between the transfer roller 26 and the support roller 23. The print paper supplied from the registration roller 14 is interposed between the transfer roller 26 and the image carrying surface of the belt 20. The transfer roller 26 transfers the toner image formed on the image carrying surface of the belt 20 to the print paper using an electrostatic force. That is, the support roller 23 and the transfer roller 26 configure the transfer unit. The toner may remain on the image carrying surface of the belt 20 without being completely transferred to the print paper. Therefore, the toner attached to the image carrying surface of the belt 20 after the image carrying surface passes through a gap between the support roller 23 and the transfer roller 26 is removed by the cleaner (not illustrated) before reaching the image forming unit 24-4.

Thus, the print engine 2 forms the image using an electrophotographic method on the print paper supplied by the registration roller 14.

The fixing unit 3 includes a fixing roller 30 and a pressurization roller 31.

In the fixing roller 30, a heater is accommodated in a hollow roller formed of, for example, a heat-resistant resin. The heater is, for example, an induction heater (IH), and any other type of heater can be appropriately used. The fixing roller 30 melts the toner that is attached to the print paper supplied from the print engine 2 such that the toner is fixed to the print paper.

The pressurization roller 31 is provided in a state where it is parallel to the fixing roller 30 and pressed against the fixing roller 30. The print paper supplied from the print engine 2 is interposed between the pressurization roller 31 and the fixing roller 30 and is pressed against the fixing roller by the fixing roller 30.

The ADU 4 includes a plurality of rollers and selectively executes the following two operations. In the first operation, the print paper that passes the fixing unit 3 is supplied to the paper discharge tray 5 as it is. The first operation is executed after completion of one-sided printing or double-sided printing. In the second operation, the print paper that passes the fixing unit 3 is temporarily conveyed to the paper discharge tray 5 side, is switched back, and is supplied to the print engine 2. The second operation is executed after completion of image formation on only one side during double-sided printing.

The paper discharge tray 5 receives the discharged print paper on which the image is formed.

Figure 2:
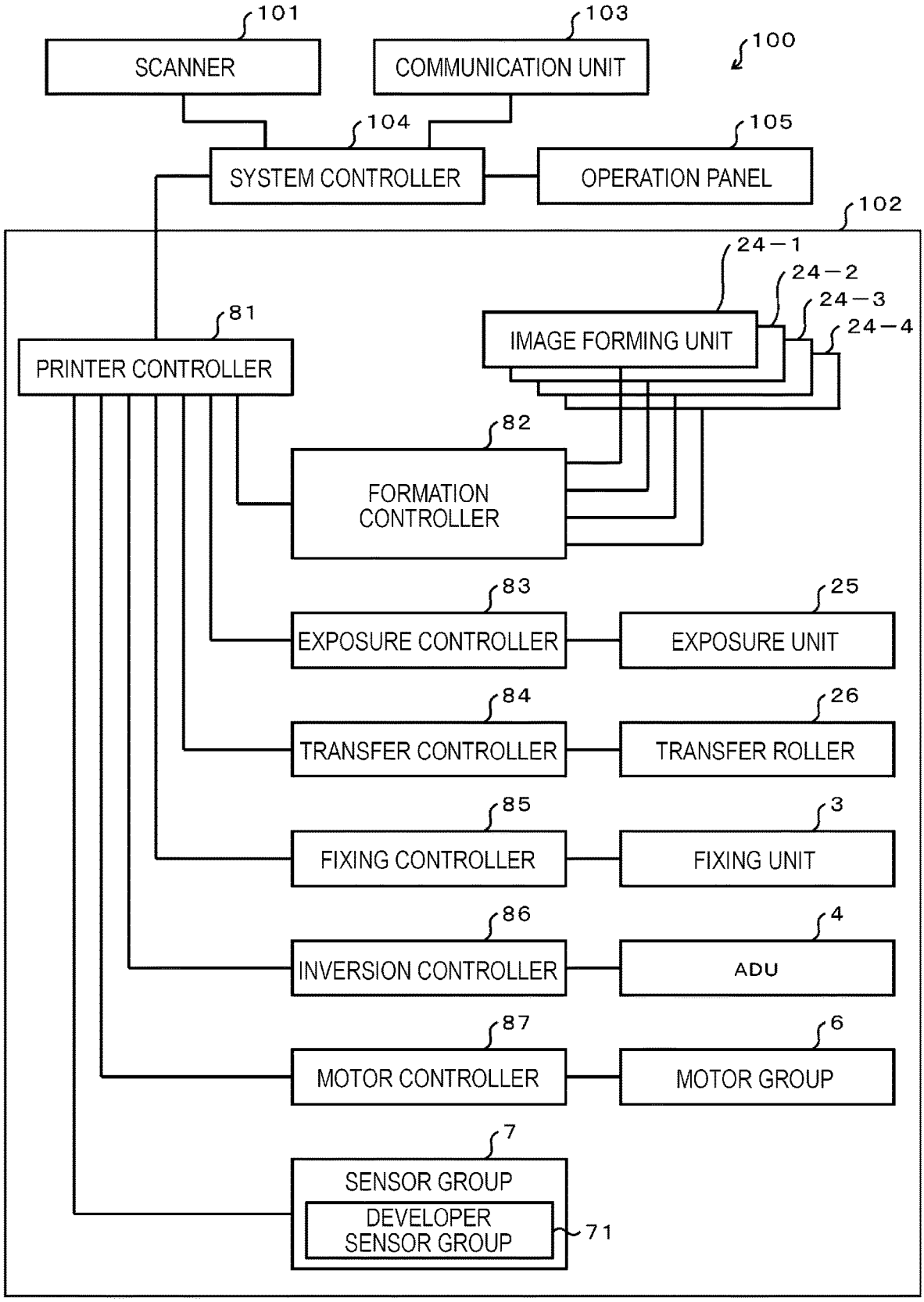
FIG. 2 is a block diagram schematically illustrating a configuration relating to a control of the MFP illustrated in FIG. 1.

FIG. 2 is a block diagram schematically illustrating a configuration relating to a control of the MFP 100. In FIG. 2, the same components as those of FIG. 1 are represented by the same reference numerals, and the detailed description thereof will not be repeated.

In addition to the scanner 101 and the printer 102, the MFP 100 includes a communication unit 103, a system controller 104, and an operation panel 105.

The communication unit 103 executes a process for communicating with an information terminal such as a computer apparatus and an image terminal such as a facsimile apparatus through a communication network such as a local area network (LAN) or a public communication network.

The system controller 104 integrally controls the respective components configuring the MFP 100 in order to implement a predetermined operation as the MFP 100. The predetermined operation as the MFP 100 is, for example, an operation for implementing various functions that are implemented by an existing MFP.

The operation panel 105 includes an input device and a display device. The operation panel 105 inputs an instruction of an operator through an input device. The operation panel 105 displays various information to be notified to the operator using the display device. As the operation panel 105, for example, a touch panel, various switches, or various lamps can be used by itself or appropriately in combination.

The fixing unit 3, the ADU 4, the image forming units 24-1 to 24-4, the exposure unit 25, and the transfer roller 26 in the printer 102 are elements to be controlled. In addition to the components, the printer 102 includes a motor group 6 as an element to be controlled. The motor group 6 includes a plurality of motors for rotating the pickup rollers 11-1, 11-2, and 11-3, the conveying rollers 12-1, 12-2, and 12-3, the conveying roller 13, the registration roller 14, the support roller 21, the transfer roller 26, the fixing roller 30, a roller in the ADU 4, and the like.

The printer 102 further includes a sensor group 7, a printer controller 81, a formation controller 82, an exposure controller 83, a transfer controller 84, a fixing controller 85, an inversion controller 86, and a motor controller 87.

The sensor group 7 includes various sensors for monitoring an operation state of the apparatus. The sensor group 7 includes a toner sensor group 71. As illustrated in FIG. 1, the toner sensor group 71 is arranged to face the image carrying surface of the belt 20 at a position between the image forming unit 24-1 and the transfer roller 26. The toner sensor group 71 includes a plurality of toner sensors. The toner sensors are arranged in the depth direction in FIG. 1. That is, the toner sensors are aligned in a direction perpendicular to the moving direction of the belt 20.

Figure 3:
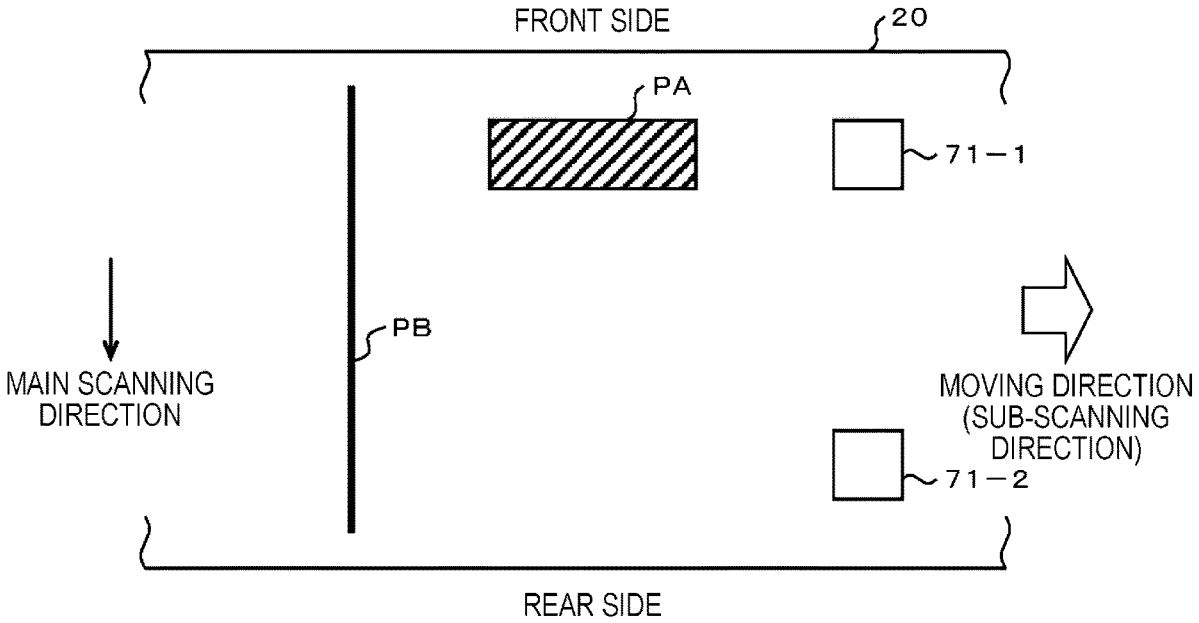
FIG. 3 is a plan view illustrating an arrangement status of toner sensors.

FIG. 3 is a plan view illustrating an arrangement status of the toner sensors.

FIG. 3 illustrates an example in which the toner sensor group 71 includes toner sensors 71-1 and 71-2. The upper side and the lower side of FIG. 3 correspond to the front side and the depth side in the depth direction in FIG. 1, respectively. In the following description, the front side in the depth direction in FIG. 1, that is, the upper side in FIG. 3 will be referred to as "front side". In addition, the depth side in the depth direction in FIG. 1, that is, the lower side in FIG. 3 will be referred to as "rear side".

The toner sensor 71-1 is positioned on the front side. The toner sensor 71-2 is positioned on the rear side. Each of the toner sensors 71-1 and 71-2 detects the toner attached to the image carrying surface of the belt 20. As the toner sensors 71-1 and 71-2, for example, a reflective optical sensor can be used. In this case, the toner sensors 71-1 and 71-2 output a voltage value as a digital value corresponding to the amount of reflected light of light emitted to the image carrying surface of the belt 20. As a result, the toner sensors 71-1 and 71-2 detect the toner attached to the image carrying surface of the belt 20 based on a difference in light reflectivity between the image carrying surface of the belt 20 and the toner. That is, each of the toner sensors 71-1 and 71-2 corresponds to the detection unit that detects the toner attached to the image carrying surface at a detection position determined between the image formation position where an image is formed by the image forming unit 24-1 and the transfer position where the image is transferred by the transfer roller 26.

The printer controller 81 illustrated in FIG. 2 integrally controls the respective components configuring the printer 102 to implement to predetermined operation as the printer 102 under the control of the system controller 104.

The formation controller 82, the exposure controller 83, the transfer controller 84, the fixing controller 85, the inversion controller 86, and the motor controller 87 operate under the control of the printer controller 81 and control operations of the image forming units 24-1 to 24-4, the exposure unit 25, the transfer roller 26, the ADU 4, and the motor group 6, respectively.

Figure 4:
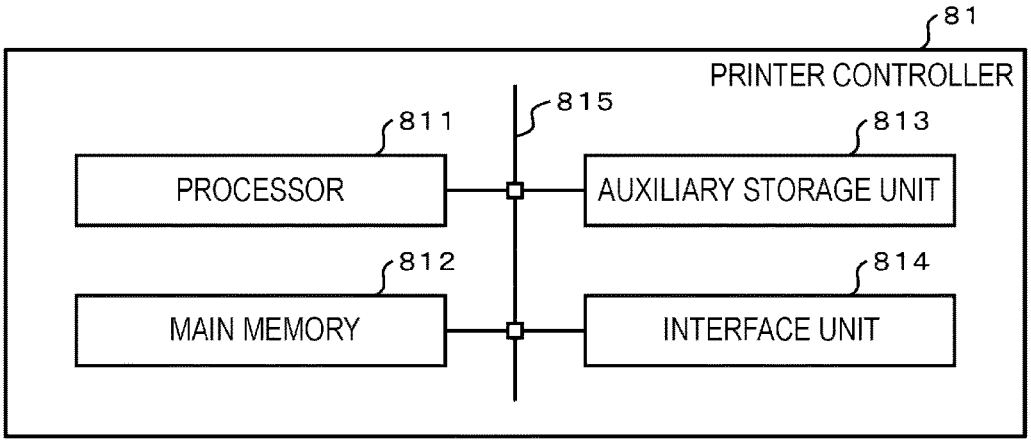
FIG. 4 is a block diagram illustrating a main circuit configuration of a printer controller illustrated FIG. 2.

FIG. 4 is a block diagram illustrating a main circuit configuration of the printer controller 81.

The printer controller 81 includes a processor 811, a main memory 812, an auxiliary storage unit 813, an interface unit 814, and a transmission line 815.

By connecting the processor 811, the main memory 812, and the auxiliary storage unit 813 through the transmission line 815, a computer that executes information processing for the control is configured.

The processor 811 corresponds to a central part of the computer. The processor 811 executes information processing described below in accordance with an information processing program such as an operating system, middleware, or an application program.

The main memory 812 corresponds to a main memory part of the computer. The main memory 812 includes a nonvolatile memory area and a volatile memory area. The main memory 812 stores the information processing program in the nonvolatile memory area. In addition, the main memory 812 may store data required for the processor 811 to execute processing for controlling the respective units in the non-volatile or volatile memory area. The main memory 812 may use the volatile memory area as a work area where data is appropriately rewritten by the processor 811.

The auxiliary storage unit 813 corresponds to an auxiliary storage part of the above-described computer. As the auxiliary storage unit 813, for example, various well-known storage devices such as an electric erasable programmable read-only memory (EEPROM), a hard disk drive (HDD), or a solid state drive (SSD) can be used by itself or in combination. The auxiliary storage unit 813 stores data used for the processor 811 to execute various processes and data generated during a process of the processor 811. The auxiliary storage unit 813 stores the information processing program.

The interface unit 814 executes well-known processes for exchanging data between the sensor group 7, the printer controller 81, the formation controller 82, the exposure controller 83, the transfer controller 84, the fixing controller 85, the inversion controller 86, and the motor controller 87. As the interface unit 814, well-known interface devices or communication devices can be used by itself or in combination.

The transmission line 815 includes an address bus, a data bus, and a control signal line, and transmits data and a control signal to be transmitted between the respective parts connected to each other.

Next, an operation of the MFP 100 configured as described above will be described. Hereinafter, an operation different from that of another existing MFP will be mainly described, and the description of other operations will not be repeated.

If the MFP 100 is powered on, the processor 811 is started by the printer controller 81. Next, the processor 811 executes a density adjustment process in accordance with an information processing program stored in the main memory 812 or the auxiliary storage unit 813.

Figure 5:
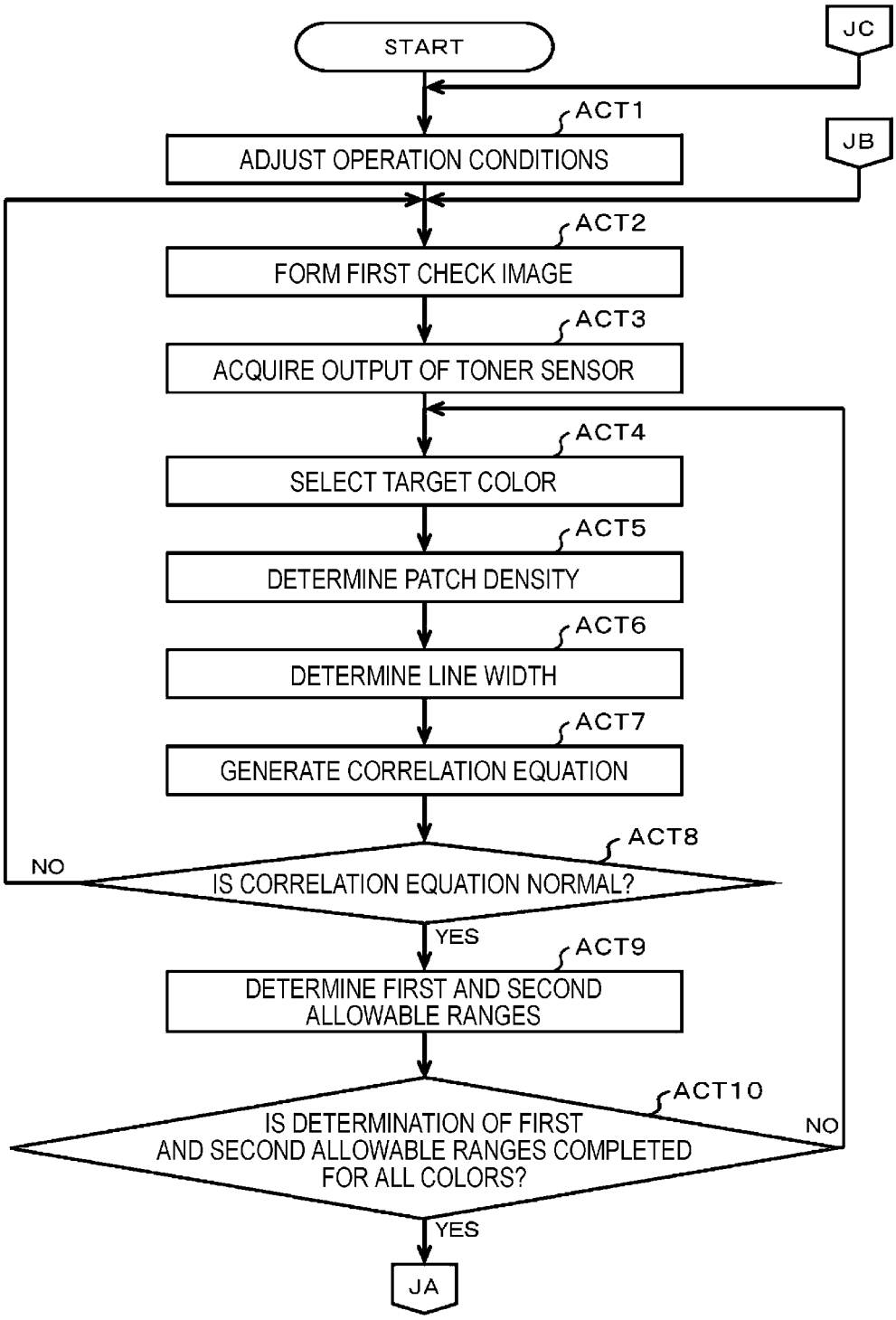
FIG. 5 is a flowchart illustrating a density adjustment process.
Figure 6:
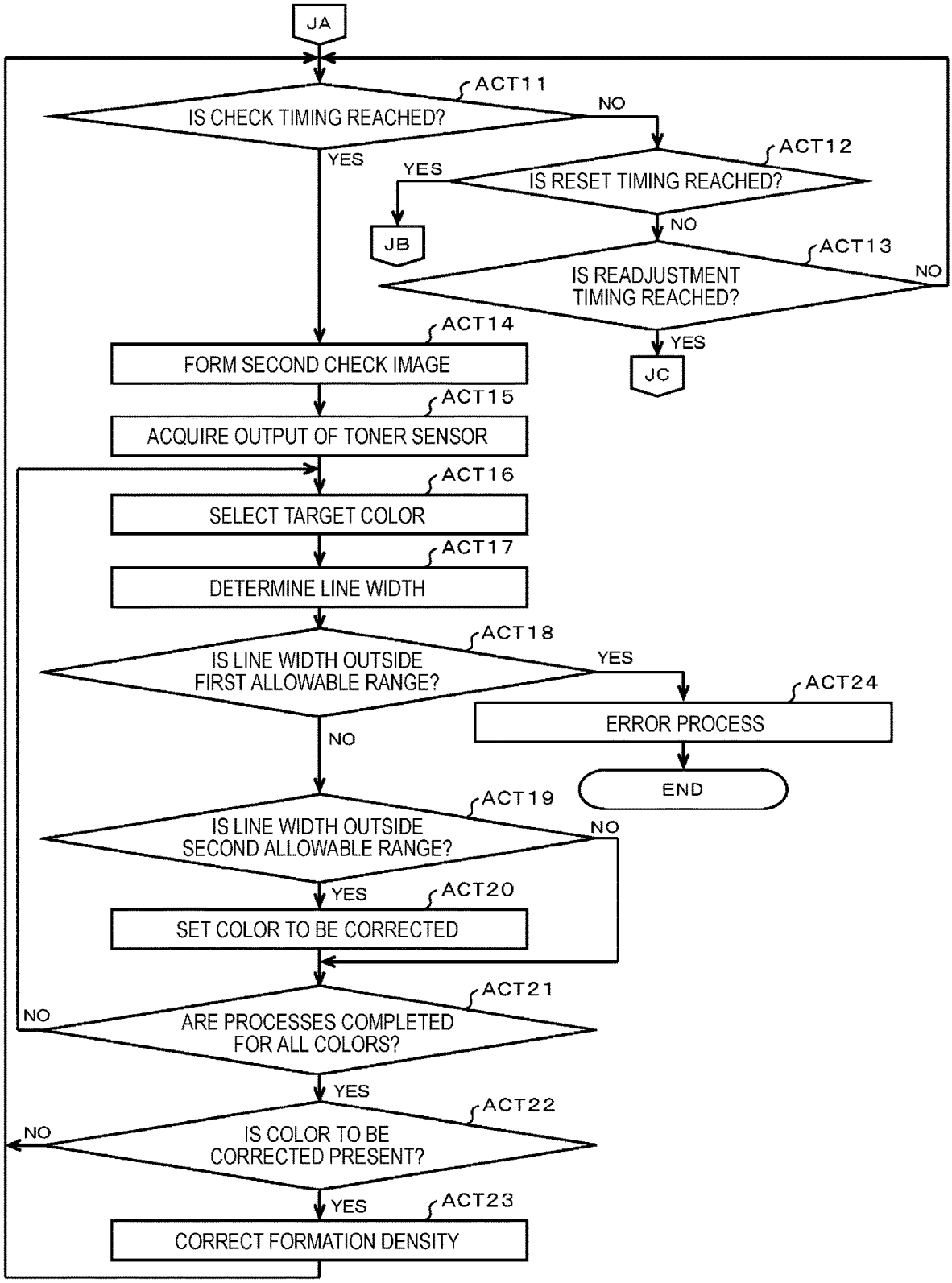
FIG. 6 is a flowchart illustrating the density adjustment process.

FIG. 5 and FIG. 6 are flowcharts illustrating the density adjustment process.

In ACT 1, the processor 811 adjusts operation conditions. The density of an image to be formed by the image forming units 24-1 to 24-4 can be changed by changing operation conditions relating to the image formation, for example, a development contrast potential, an exposure amount, or a proportion of a screen in a process of image data. In addition, the density of an image to be formed by the image forming units 24-1 to 24-4 varies depending on preconditions during the image formation, for example, a surrounding environment or a deterioration degree of the photoreceptor and the belt 20. Therefore, the processor 811 adjusts the operation conditions relating to the image formation such that the density of an image that is actually formed is a predetermined density. Here, a specific process of the processor 811 may be the same as a process that is executed in another existing MFP. As a process for setting the operation conditions, for example, a process called patch density matching, density tone adjustment, FR density adjustment, or the like is known. The patch density matching is a process of adjusting the amount of toner when forming an image having a density of 100%. The density tone adjustment is a process of adjusting the amount of toner when forming an image having an intermediate density. The FR density adjustment is a process of adjusting a variation in density between the front side and the rear side. By adjusting the operation conditions, the density of an image to be formed can be made to be close to a desired density. However, the density of an image that is actually formed varies depending on a variation in surrounding environment.

Hereinafter, the density of an image to be formed by the image forming units 24-1 to 24-4 will be referred to as "formation density", and the actual density of an image that is formed will be referred to as "image density".

In ACT 2, the processor 811 forms a first check image. That is, the processor 811 instructs the formation controller 82 and the exposure controller 83 to operate the image forming units 24-1 to 24-4 and the exposure unit 25 such that the first check image is formed on the image carrying surface of the belt 20. At this time, the processor 811 does not operate the transfer roller 26, the fixing unit 3, the ADU 4, and the motor group 6 and does not transfer the first check image to the print paper. Accordingly, by the processor 811 executing the information processing based on the information processing program, a computer including the processor 811 as a central part functions as the first control unit configured to control the image forming units 24-1 to 24-4 as the image forming units such that the first check image is formed.

FIG. 3 illustrates a state where the first check image including a patch pattern PA and a line pattern PB is formed on the image carrying surface of the belt 20. In this case, FIG. 3 illustrates the patch pattern PA and the line pattern PB of one color. Actually, the first check image includes patch patterns PA and line patterns PB of the remaining three colors in a state where the patch patterns PA and the line patterns PB are sequentially aligned in a sub-scanning direction. That is, the processor 811 operates the image forming units 24-1 to 24-4 and the exposure unit 25 such that the patch patterns PA and the line patterns PB of the respective colors including yellow, magenta, cyan, and black are formed to be spaced from each other.

The patch pattern PA is a rectangular pattern that is colored at a uniform density and formed in a region having a predetermined area. The formation density of the patch pattern PA may be typically 100% and may be an intermediate formation density. The patch pattern PA is represented by hatching in FIG. 3 and is actually formed if the toner is uniformly attached to the entire target region. The formation density of the patch pattern may be appropriately determined, for example, by a designer of the MFP 100. It is assumed that the formation density of the patch pattern is, for example, a density corresponding to a density level of 100%. A formation position of the patch pattern PA is set as a position that passes through a detection position of the toner sensor 71-1. The formation density, area, and shape of the patch pattern PA may be appropriately determined, for example, by the designer of the MFP 100 such that the image density of the patch pattern PA can be detected by the toner sensor 71-1. That is, as the formation density and the area of the patch pattern PA decrease, the amount of the toner reduced can be reduced. However, there is a concern that the patch density cannot be appropriately detected by the toner sensors 71-1 and 71-2 due to reflection from the periphery of the patch pattern PA. Therefore, the formation density and the area of the patch pattern PA should be set in consideration of various factors such as characteristics of the toner sensors 71-1 and 71-2 or the amount of the toner that is allowed during the formation of the patch pattern PA. In addition, the shape of the patch pattern PA may be another shape such as a polygonal shape other than a rectangular shape or a circular shape as long as the patch density can be appropriately detected by the toner sensors 71-1 and 71-2.

The line pattern PB is a line that has a predetermined width in the sub-scanning direction and extends in the main scanning direction. It is assumed that the width of the line pattern PB is, for example, 1 mm. The length of the line pattern PB in the main scanning direction and the formation position thereof are set in a state where the line pattern PB passes through detection positions of the toner sensors 71-1 and 71-2. It is not necessary to form a portion of the line pattern PB that does not pass through the detection positions of the toner sensors 71-1 and 71-2. In this case, the first check image that is actually formed is not necessarily as designed.

After the patch pattern PA passes through the detection position of the toner sensor 71-1, the line pattern PB passes through the detection positions of the toner sensors 71-1 and 71-2. At this time, the output voltage value of the toner sensor 71-1 changes depending on a change in reflectivity caused by the toner that forms the patch pattern PA and the line pattern PB. The output voltage value of the toner sensor 71-2 changes depending on a change in reflectivity caused by the toner that forms the line pattern PB.

In ACT 13, the processor 811 acquires the output voltage values of the toner sensors 71-1 and 71-2 at regular time intervals in a predetermined acquisition period, correlate the acquired output voltage values with an acquisition time, and stores the output voltage values and the acquisition time in the main memory 812 or the auxiliary storage unit 813. The acquisition period is determined by, for example, the designer of the MFP 100 as a period including a period where the first check image passes through the detection positions of the toner sensors 71-1 and 71-2. If the acquisition period ends, the processor 811 proceeds to ACT 4.

In ACT 4, the processor 811 selects any one of yellow, magenta, cyan, and black as a color to be processed (hereinafter, referred to as "target color").

In ACT 5, the processor 811 determines the patch density of a target color. For example, based on a voltage value acquired from the toner sensor 71-1, the processor 811 determines an output voltage from the toner sensor 71-1 if the patch pattern PA of the target color passes through the detection position, and determines the patch density as a density corresponding to the output voltage.

In ACT 6, the processor 811 determines the line width on each of the front side and the rear side regarding the line pattern PB of the target color. For example, the processor 811 analyzes a change in the voltage value acquired from the toner sensor 71-1 for the line pattern PB of the target color and detects respective positions of a front edge (hereinafter, referred to as "first edge") and a rear edge (hereinafter, referred to as "second edge") in the sub-scanning direction.

Figure 7:
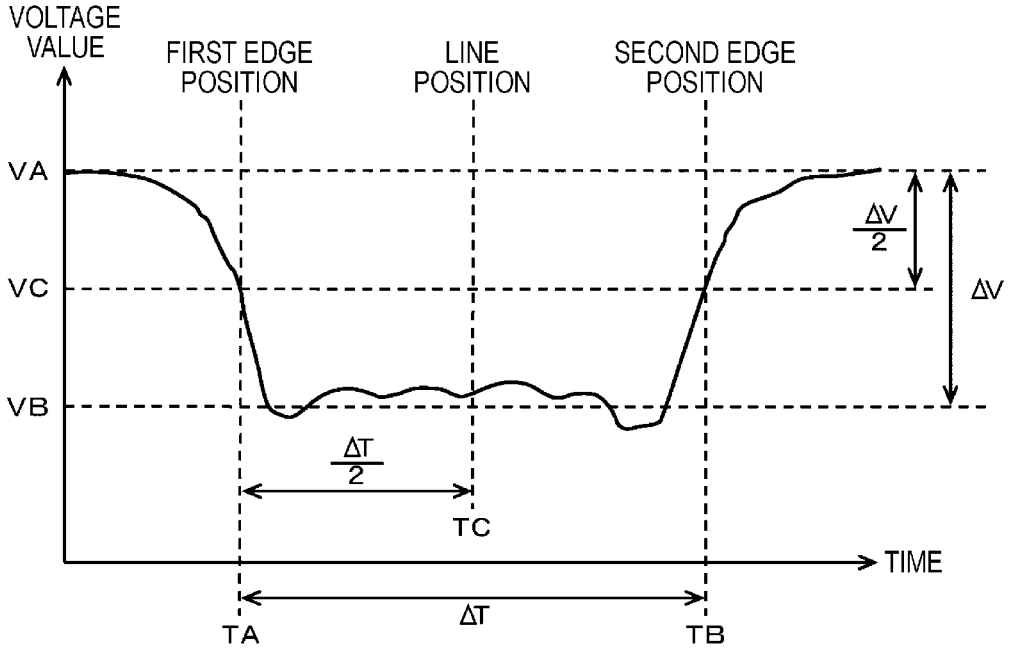
FIG. 7 is a graph illustrating a change in output voltage value of the toner sensor.

FIG. 7 is a graph representing a change in output voltage value of the toner sensor 71-1.

FIG. 7 illustrates only a period where one line pattern PB passes through the detection position of the toner sensor 71-1.

A voltage value VA is a voltage value corresponding to the reflectivity on the image carrying surface of the belt 20. A voltage value VB is an average output voltage value that is decreased by the line pattern PB.

If the output voltage value of the toner sensor 71-1 changes as illustrated in FIG. 7, the processor 811 detects the positions of the first edge and the second edge, for example, through the following process.

The processor 811 may determine, for example, a peak value of the output voltage value of the toner sensor 71-1 as the voltage value VA, and may determine a predetermined value as the voltage value VA, the predetermined value being a voltage value to be output from the toner sensor 71-1 if a region of the image carrying surface of the belt 20 to which the toner is not attached passes through the detection position of the toner sensor 71-1. The processor 811 calculates an average value of output voltage values in a period where the output voltage value of the toner sensor 71-1 decreases and sets the average value as the voltage value VB. The processor 811 calculates a difference Δ between the voltage value VA and the voltage value VB. The processor 811 calculates a voltage value VC obtained by subtracting ΔV/2 from the voltage value VA. The processor 811 may calculate the voltage value VC through another equivalent process, for example, a process of adding the voltage value VB to ΔV/2 to calculate the voltage value VC. The processor 811 sets, as the position of the first edge, time TA at which the output voltage value of the toner sensor 71-1 decreases up to the voltage value VC. In addition, the processor 811 sets, as the position of the second edge, time TB at which the output voltage value of the toner sensor 71-1 increases up to the voltage value VC. For example, the processor 811 calculates the line width of the front side as the product of a period of time ΔT between time TA and time TB and a moving speed of the image carrying surface of the belt 20. The processor 811 may use ΔT as a value representing the line width of the front side as it is.

The processor 811 determines the line width of the rear side by executing the same process as described above regarding the voltage value acquired from the toner sensor 71-2.

In ACT 7, the processor 811 generates a correlation equation representing a correlation between the patch density and the line width of the target color for each of the front side and the rear side. Thus, by the processor 811 executing the information processing based on the information processing program, a computer including the processor 811 as a central part functions as the relationship determination unit.

Figure 8:
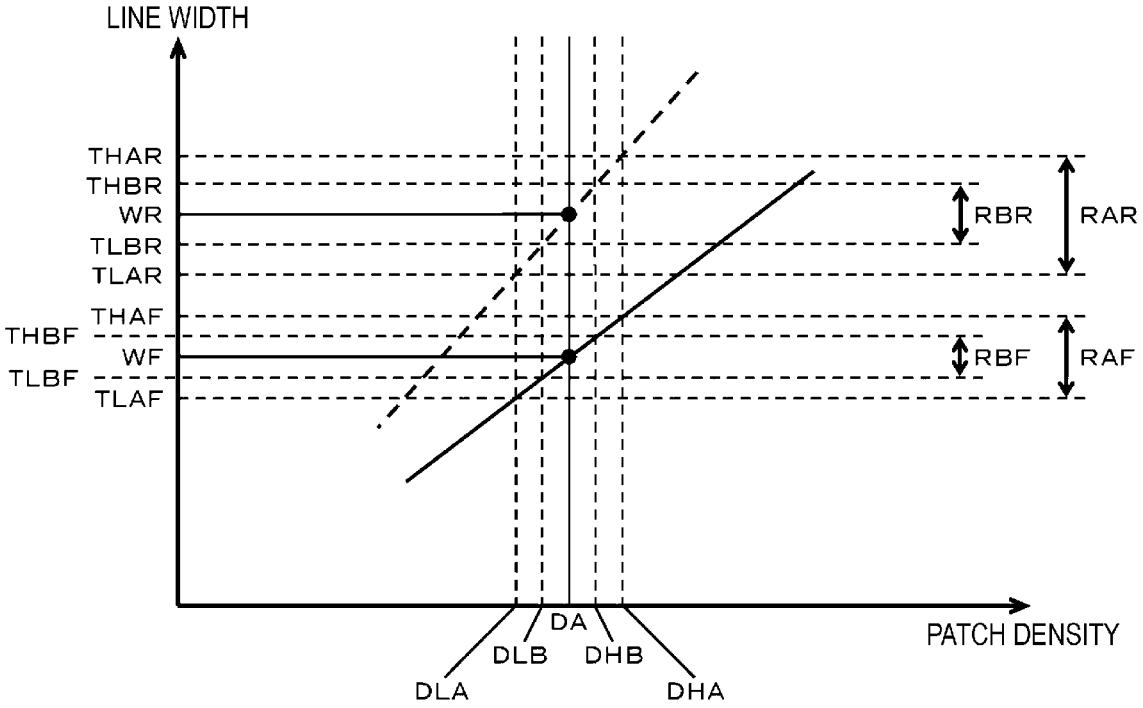
FIG. 8 is a diagram illustrating a concept of generation of a correlation equation.

FIG. 8 is a diagram illustrating a concept of generation of a correlation equation.

The processor 811 generates, for example, the correlation equation for the rear side as a linear function representing a straight line (straight line indicated by a solid line in FIG. 8), where DA represents the patch density determined in ACT 5 regarding the target color, and WF represents the line width of the front side determined in ACT 6, the straight line passes through the point (DA,WF) on the xy plane where the x-axis represents the patch density and the y-axis represents the line width as shown in FIG. 8, and the solid line has a predetermined tilt for the front side. The processor 811 generates, for example, the correlation equation for the front side as a linear function representing a straight line (straight line indicated by a broken line in FIG. 8), where WR represents the line width of the rear side determined in ACT 6 regarding the target color, and the straight line passes through the points (DA, WR) on the xy plane and has a predetermined tilt for the rear side. The tilt of the front side and the tilt of the rear side are appropriately determined, for example, by the designer of the MFP 100 in consideration of characteristic of each of the toner sensors 71-1 and 71-2. By determining some tilts depending on the degree of deterioration of the photoreceptor, the processor 811 may selectively apply the tilt depending on the degree of deterioration of the photoreceptor.

In ACT 8, the processor 811 checks whether or not the correlation equation generated in ACT 7 is normal. Here, the relationship between the patch density and the line width varies depending on the surrounding environment or the like but does not vary dramatically. Therefore, the correlation equation is not largely different from a theoretically assumed equation. However, due to some abnormality, an error for the determination of the patch density or the line width may increase. In this case, the correlation equation may be largely different from a theoretically assumed equation. In this case, the processor 811 determines NO and that the correlation equation is not normal and executes ACT 2 or subsequent processes again. For example, the line pattern is likely to be affected by unevenness in the sub-scanning direction, and in a state where there is unevenness in the photoreceptor pitch, there may be a case where the line width is abnormally narrowed with respect to the patch density. Therefore, for example, the designer of the MFP 100 sets an appropriate range of the correlation equation that can be determined in consideration of factors of a variation in image formation, for example, characteristics of the toner sensors 71-1 and 71-2 and the belt 20. If the correlation equation generated in ACT 7 is outside an appropriate range, the processor 811 determines NO in ACT 8 and executes ACT 2 or subsequent processes again. If the correlation equation is normal, the processor 811 determines YES in ACT 8 and proceeds to ACT 9.

In ACT 9, the processor 811 determines a first allowable range and a second allowable range regarding each of the front side and the rear side. The first allowable range and the second allowable range are allowable ranges regarding the line width determined as described below, and the first allowable range is wider than the second allowable range.

For example, as illustrated in FIG. 8, regarding the relational expression of the front side, the processor 811 determines, as a lower limit threshold TLAF in the first allowable range of the front side, a line width corresponding to an x coordinate of a point having a density value DLA as a y coordinate, the density value DLA obtained by subtracting a first predetermined value from the patch density DA. For example, as illustrated in FIG. 8, regarding the relational expression of the front side, the processor 811 determines, as an upper limit threshold THAF in the first allowable range of the front side, a line width corresponding to an x coordinate of a point having a density value DHA as a y coordinate, the density value DHA obtained by adding a second predetermined value to the patch density DA. Thus, the first allowable range relating to the front side is a range RAF in FIG. 8.

For example, as illustrated in FIG. 8, regarding the relational expression of the front side, the processor 811 determines, as a lower limit threshold TLBF in the second allowable range of the front side, a line width corresponding to an x coordinate of a point having a density value DLB as a y coordinate, the density value DLB obtained by subtracting a third predetermined value from the patch density DA. For example, as illustrated in FIG. 8, regarding the relational expression of the front side, the processor 811 determines, as an upper limit threshold THBF in the second allowable range of the front side, a line width corresponding to an x coordinate of a point having a density value DHB as a y coordinate, the density value DHB obtained by adding a fourth predetermined value to the patch density DA. Thus, the second allowable range relating to the front side is a range RBF in FIG. 8.

For example, as illustrated in FIG. 8, regarding the relational expression of the rear side, the processor 811 determines, as a lower limit threshold TLAR in the first allowable range of the rear side, the line width corresponding the x coordinate of the point having the density value DLA as the y coordinate. For example, as illustrated in FIG. 8, regarding the relational expression of the rear side, the processor 811 determines, as an upper limit threshold THAR in the first allowable range of the rear side, the line width corresponding the x coordinate of the point having the density value DHA as the y coordinate. Thus, the first allowable range relating to the rear side is a range RAR in FIG. 8.

For example, as illustrated in FIG. 8, regarding the relational expression of the rear side, the processor 811 determines, as a lower limit threshold TLBF in the second allowable range of the rear side, the line width corresponding the x coordinate of the point having the density value DLB as the y coordinate. For example, as illustrated in FIG. 8, regarding the relational expression of the rear side, the processor 811 determines, as an upper limit threshold THBR in the second allowable range of the rear side, the line width corresponding the x coordinate of the point having the density value DHB as the y coordinate. Thus, the second allowable range relating to the rear side is a range RBR in FIG. 8.

Here, the first to fourth predetermined values are appropriately determined, for example, by the designer of the MFP 100. The third predetermined value and the fourth predetermined value are less than the first predetermined value and the second predetermined value. The first predetermined value and the second predetermined value are assumed to be the same value but may be different from each other. The third predetermined value and the fourth predetermined value are assumed to be the same value but may be different from each other.

This way, the processor 811 determines the first allowable range and the second allowable range as the allowable ranges of the width of the line pattern PB based on the correlation between the density of the patch pattern PA and the width of the line pattern PB. Thus, by the processor 811 executing the information processing based on the information processing program, a computer including the processor 811 as a central part functions as the determination unit.

In ACT 10, the processor 811 checks whether or not the execution of the determination of the first and second allowable ranges is completed for all of the colors. In addition, if a color other than the target color is present, the processor 811 determines NO and repeats the processes after ACT 4 while changing the target color. As a result, the processor 811 determines the first and second allowable ranges for each of the colors including yellow, magenta, cyan, and black. After completing the determination of the first and second allowable ranges for all of the colors, the processor 811 proceeds to ACT 10. In this case, the processor 811 determines YES and that the determination is completed for all of the colors and proceeds to ACT 11 in FIG. 6.

In ACT 11, the processor 811 checks whether or not a check timing is reached. If the event cannot be checked, the processor 811 determines NO and proceeds to ACT 12.

In ACT 12, the processor 811 checks whether or not a reset timing is reached. If the event cannot be checked, the processor 811 determines NO and proceeds to ACT 13.

In ACT 13, the processor 811 checks whether or not a readjustment timing is reached. If the event cannot be checked, the processor 811 determines NO and proceeds to ACT 11.

Thus, in ACT 11 to ACT 13, the processor 811 waits until any one of the check timing, the reset timing, or the readjustment timing is reached.

The check timing is a predetermined timing at which the density should be checked. The check timing may be freely determined, for example, by the designer of the MFP 100. The check timing is determined to be repeated, for example whenever the MFP 100 operates for a given period of time. It is assumed that the check timing is a timing at which, for example, a cumulative number of sheets printed a cumulative driving time of the belt 20, the photoreceptor, or the developing unit from the previous check timing reaches a predetermined value. Alternatively, it is assumed that the check timing is reached, for example, at predetermined time intervals. Alternatively, it is assumed that the check timing is, for example, a timing at which the surrounding environment such as humidity varies largely.

The reset timing is a timing at which a first threshold and a second threshold should be reset. The reset timing may be freely determined, for example, by the designer of the MFP 100. The reset timing is determined to be repeated, for example whenever the MFP 100 operates for a given period of time. The reset timing is determined such that the check timing is reached multiple times between two reset timings.

The readjustment timing is a timing at which the operation conditions in ACT 1 should be adjusted again. The readjustment timing may be freely determined, for example, by the designer of the MFP 100. The readjustment timing is determined to be repeated, for example whenever the MFP 100 operates for a given period of time. The readjustment timing is determined such that the reset timing is reached multiple times between two readjustment timings.

If the check timing is reached, the processor 811 determines YES in ACT 11 and proceeds to ACT 14.

In ACT 14, the processor 811 forms a second check image. That is, the processor 811 instructs the formation controller 82 and the exposure controller 83 to operate the image forming units 24-1 to 24-4 and the exposure unit 25 such that the second check image is formed on the image carrying surface of the belt 20. At this time, the processor 811 does not operate the transfer roller 26, the fixing unit 3, the ADU 4, and the motor group 6 and does not transfer the second check image to the print paper. Accordingly, by the processor 811 executing the information processing based on the information processing program, a computer including the processor 811 as a central part functions as the second control unit configured to control the image forming units 24-1 to 24-4 as the image forming units such that the second check image is formed.

Figure 9:
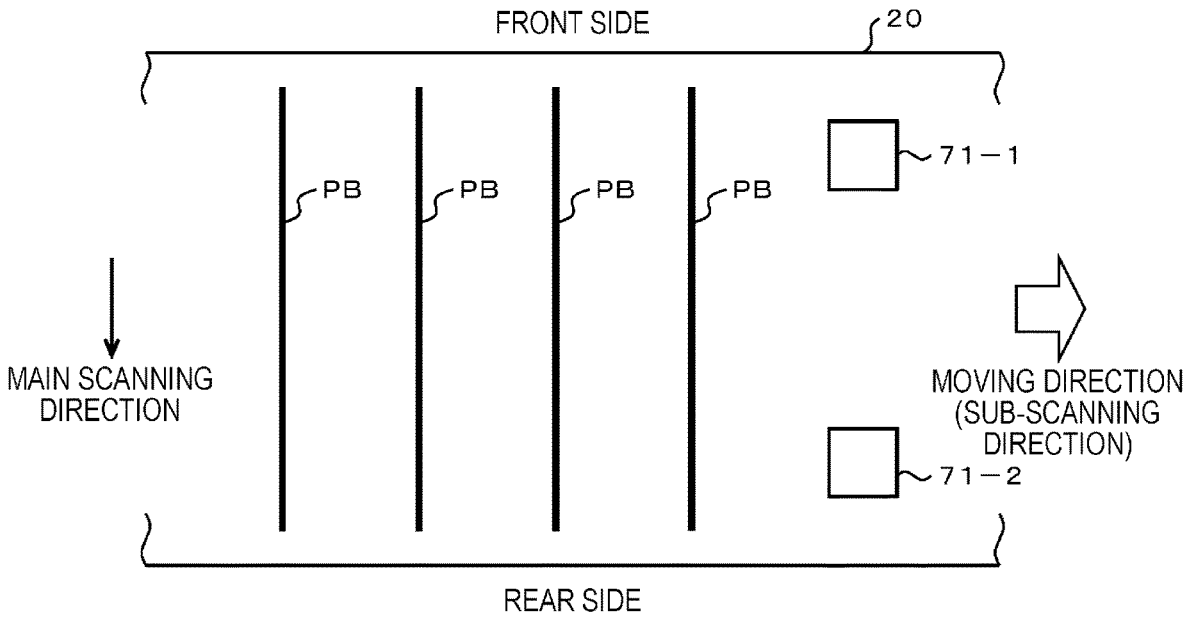
FIG. 9 is a diagram illustrating a state where a second check image is formed on an image carrying surface of a belt 20.

FIG. 9 is a diagram illustrating a state where the second check image is formed on the image carrying surface of the belt 20.

The second check image includes line patterns PB of the respective colors including yellow, magenta, cyan, and black. That is, the processor 811 operates the image forming units 24-1 to 24-4 and the exposure unit 25 such that the line patterns PB of the respective colors including yellow, magenta, cyan, and black are formed to be spaced from each other.

The line patterns PB of the respective colors sequentially pass through the detection positions of the toner sensors 71-1 and 71-2.

In ACT 15, the processor 811 acquires the output voltage values of the toner sensors 71-1 and 71-2 at regular time intervals in a predetermined acquisition period, correlate the acquired output voltage values with an acquisition time, and stores the output voltage values and the acquisition time in the main memory 812 or the auxiliary storage unit 813. The acquisition period is determined by, for example, the designer of the MFP 100 as a period including a period where the second check image passes through the detection positions of the toner sensors 71-1 and 71-2. If the acquisition period ends, the processor 811 proceeds to ACT 16.

In ACT 16, the processor 811 selects any one of yellow, magenta, cyan, and black as a color to be processed (hereinafter, referred to as "target color").

In ACT 17, using the same method as that of ACT 6, the processor 811 determines line widths WF and WR on the front side and the rear side regarding the line pattern PB of the target color. Thus, by the processor 811 executing the information processing based on the information processing program, a computer including the processor 811 as a central part functions as the line width determination unit.

In ACT 18, the processor 811 determines whether or not the line width WF determined in ACT 17 is outside the first allowable range of the front side determined in ACT 9 or whether or not the line width WR determined in ACT 17 is outside the first allowable range of the rear side determined in ACT 9. For example, if [the lower limit threshold TLAF≤the line width WF≤the upper limit threshold THAF] is not satisfied, the processor 811 determines that the line width WF is outside the first allowable range. For example, if any one of [the lower limit threshold TLAF<the line width WF≤the upper limit threshold THAF], [the lower limit threshold TLAF≤the line width WF<the upper limit threshold THAF], or [the lower limit threshold TLAF<the line width WF<the upper limit threshold THAF] is not satisfied, the processor 811 may determine that the line width WF is outside the first allowable range. For example, if [the lower limit threshold TLAR≤the line width WR≤the upper limit threshold THAR] is not satisfied, the processor 811 determines that the line width WR is outside the first allowable range. For example, if any one of [the lower limit threshold TLAR<the line width WR≤the upper limit threshold THAR], [the lower limit threshold TLAR≤the line width WR<the upper limit threshold THAR], or [the lower limit threshold TLAR<the line width WR<the upper limit threshold THAR] is not satisfied, the processor 811 may determine that the line width WR is outside the first allowable range. If the line width WF is outside the first allowable range but the line width WR cannot be determined to be outside the first allowable range, the processor 811 determines NO in ACT 18 and proceeds to ACT 19.

In ACT 19, the processor 811 determines whether or not the line width WF determined in ACT 17 is outside the second allowable range of the front side determined in ACT 9 or whether or not the line width WR determined in ACT 17 is outside the second allowable range of the rear side determined in ACT 9. For example, if [the lower limit threshold TLBF≤the line width WF≤the upper limit threshold THBF] is not satisfied, the processor 811 determines that the line width WF is outside the second allowable range. For example, if any one of [the lower limit threshold TLBF<the line width WF≤the upper limit threshold THBF], [the lower limit threshold TLBF≤the line width WF<the upper limit threshold THBF], or [the lower limit threshold TLBF<the line width WF<the upper limit threshold THBF] is not satisfied, the processor 811 may determine that the line width WF is outside the second allowable range. For example, if [the lower limit threshold TLBR≤the line width WR≤the upper limit threshold THBR] is not satisfied, the processor 811 determines that the line width WR≤is outside the second allowable range. For example, if any one of [the lower limit threshold TLBR<the line width WR≤the upper limit threshold THBR], [the lower limit threshold TLBR≤the line width WR<the upper limit threshold THBR], or [the lower limit threshold TLBR<the line width WR<the upper limit threshold THBR] is not satisfied, the processor 811 may determine that the line width WR is outside the second allowable range. If the line width WF cannot be determined to be outside the second allowable range or the line width WR cannot be determined to be outside the second allowable range, the processor 811 determines YES in ACT 19 and proceeds to ACT 20.

In ACT 20, the processor 811 sets a color of which the density should be corrected as the target color.

The processor 811 proceeds from ACT 20 to ACT 21. If the line width WF is outside the second allowable range but the line width WR cannot be determined to be outside the second allowable range, the processor 811 determines NO in ACT 19, skips ACT 20, and proceeds to ACT 21.

This way, the processor 811 monitors whether or not the formation density of the target color should be corrected by comparing the line width WF and the second allowable range to each other. Thus, by the processor 811 executing the information processing based on the information processing program, a computer including the processor 811 as a central part functions as the monitoring unit.

In ACT 21, the processor 811 checks whether or not the execution of the processes of ACT 16 to ACT 20 is completed for all of the colors. In addition, if a color other than the target color is present, the processor 811 determines NO and repeats the processes after ACT 16 while changing the target color. As a result, if the processor 811 proceeds to ACT 21 in a state where the selection of the target color from the respective colors including yellow, magenta, cyan, and black is completed, the processor 811 determines YES and that the selection is completed and proceeds to ACT 22.

In ACT 22, the processor 811 checks whether or not the color set in ACT 20 is present as the color to be corrected while repeating the loop of ACT 16 to ACT 21. If the number of the corresponding color is one, the processor 811 determines YES and proceeds to ACT 23.

In ACT 23, the processor 811 corrects the formation density for the color set in ACT 20 as the color to be corrected. For example, if the processor 811 satisfies [the line width WF<the lower limit threshold TLBF] for yellow, the processor 811 changes the operation conditions of the image forming unit 24-1 such that the formation density relating to the front side increases. The processor 811 changes an image processing screen such that, for example, the formation density relating to the front side increases. That is, for example, the processor 811 increases the formation density of the front side, for example, by increasing the size of one dot or increasing the number of dots regarding each of the dots belonging to the front side. Alternatively, the processor 811 may increase the formation density of the front side by adjusting the amount of light emitted from the exposure unit 25. Thus, by the processor 811 executing the information processing based on the information processing program, a computer including the processor 811 as a central part functions as the correction unit.

If the correction of the formation density is completed for all of the colors set in ACT 20 as the color to be corrected, the processor 811 returns to waiting state of ACT 11 to ACT 13. If the color set in ACT 20 is not present as the color to be corrected, the processor 811 determines NO in ACT 22, skips ACT 23, and returns to the waiting state of ACT 11 to ACT 13.

As described above, the check of the formation density based on the line width of the line pattern PB using the second check image and the optional adjustment of the formation density are repeatedly executed whenever the check timing is reached. The same first allowable range and the same second allowable range are applied at continuous several times of check timings. If continuous several times of check timings are passed and the reset timing is reached, the processor 811 determines YES in ACT 12, returns to ACT 2 in FIG. 5, and executes the processes after ACT 2 as described above. That is, the processor 811 determines the first allowable range and the second allowable range again based on the first check image. Thus, by the processor 811 executing the information processing based on the information processing program, a computer including the processor 811 as a central part functions as the third control unit.

As described above, if the first allowable range and the second allowable range are repeated several times such that the readjustment timing is reached, the processor 811 determines YES in ACT 13 in FIG. 6 and executes the processes after ACT 1 in FIG. 5 as described above. As a result, the processor 811 executes the readjustment of the formation density again by adjusting the operation conditions in ACT 1, and the processor 811 returns the operation state of the printer 102 to an appropriate state.

This way, by optionally repeating the correction of the formation density in ACT 23, the processor 811 controls the image density such that the image density is in the second allowable range. However, for example, the image density may vary significantly due to some reasons such as a significant variation in surrounding environment or malfunction of the image forming units 24-1 to 24-4. As a result, if the line width WF determined in ACT 17 is outside the first allowable range of the front side determined in ACT 9 or if the line width WR determined in ACT 17 is outside the first allowable range of the rear side determined in ACT 9, the processor 811 determines YES in ACT 18 and proceeds to ACT 24.

In ACT 24, the processor 811 executes an error process. The error process is a process for urging a user or a maintenance person to deal with abnormality of the apparatus. The error process may be appropriately determined, for example, by the designer or a manager of the MFP 100. As one error process, for example, the processor 811 requests the system controller 104 to control the printer 102 to inhibit the execution of a job where the printer 102 is used. As one error process, for example, the processor 811 causes the operation panel 105 to display a warning screen for urging the user to deal with abnormality. After completing the error process, the processor 811 temporarily ends the density adjustment process. For example, if the abnormality is resolved, the processor 811 starts the density adjustment process again. Thus, by the processor 811 executing the information processing based on the information processing program, a computer including the processor 811 as a central part functions as the processing unit that executes the error process as a predetermined process for dealing with abnormality.

This way, the processor 811 monitors whether or not the formation status of an image is abnormal by comparing the line width WF and the first allowable range to each other. Thus, by the processor 811 executing the information processing based on the information processing program, a computer including the processor 811 as a central part functions as the monitoring unit.

As described above, in the MFP 100, by forming the first check image including the patch pattern PA and the line pattern PB, the first and second allowable ranges are determined based on the correlation between the density of the patch pattern PA and the width of the line pattern PB. The formation status of an image is monitored by comparing the width of the line pattern PB during the formation of the second check image including the line pattern PB to the first and second allowable ranges. Thus, the formation status of an image, for example, whether or not the correction of the formation density is necessary or whether or not the image density is abnormal can be appropriately monitored based on the width of the line pattern PB.

In addition, in the MFP 100, if the width of the line pattern PB is outside the first allowable range, the formation status of the image is determined to be abnormal, and the error process is executed. As a result, image formation can be prevented from being continued in a state where the formation status is abnormal.

In addition, in the MFP 100, if the width of the line pattern PB is outside the second allowable range, the processor 811 corrects the formation density. Thus, the image formation in a formation status where a desired image density can be obtained can be continued for a longer period of time.

In addition, the MFP 100 determines both the density of the patch pattern PA and the width of the line pattern PB in the first check image and the width of the line pattern PB in the second check image based on the toner detection result of the toner sensor 71-1. Thus, these determinations can be implemented with a simpler configuration as compared to a case where different sensors and the like are used for the determinations.

In addition, in the MFP 100, the first allowable range and the second allowable range are reset whenever the reset timing is reached. Thus, if the correlation between the density of the patch pattern PA and the width of the line pattern PB varies significantly depending on the deterioration of the photoreceptor and the like, the first allowable range and the second allowable range can be adjusted to be in the ranges based on the correlation after the variation, and the formation status of an image can be appropriately monitored.

This embodiment can be modified as follows in various ways.

The processor 811 may determine the density of the patch pattern PA and the width of the line pattern PB in the first check image by analyzing the image data generated by the scanner 101. In this case, if the first check image is formed in ACT 2 in FIG. 5, the processor 811 operates the transfer roller 26, the fixing unit 3, the ADU 4, and the motor group 6 and transfers the first check image to the print paper. In this case, the function as the output unit is implemented by the processor 811, the transfer roller 26, the fixing unit 3, the ADU 4, and the motor group 6. Between ACT 2 and ACT 3, the processor 811 waits until the print paper to which the first check image is transferred is scanned by the scanner 101. In ACT 3, the processor 811 scans the print paper to which the first check image is transferred and acquires image data generated by the scanner 101. Further, in ACT 5 and ACT 6, the processor 811 analyzes the image data and determines the patch density and the line width.

With this configuration, the toner sensor 71-1 can also be used as an inexpensive device that can detect only whether or not toner is present without detecting the density.

The processor 811 may set the position that passes through the detection position of the toner sensor 71-2 as the formation position of the patch pattern PA in the first check image. In this case, based on a voltage value acquired from the toner sensor 71-2, the processor 811 determines an output voltage from the toner sensor 71-1 if the patch pattern PA of the target color passes through the detection position, and determines the patch density as a density corresponding to the output voltage.

The processor 811 may use another image different from the image illustrated in FIG. 6 as the second check image.

Figure 10:
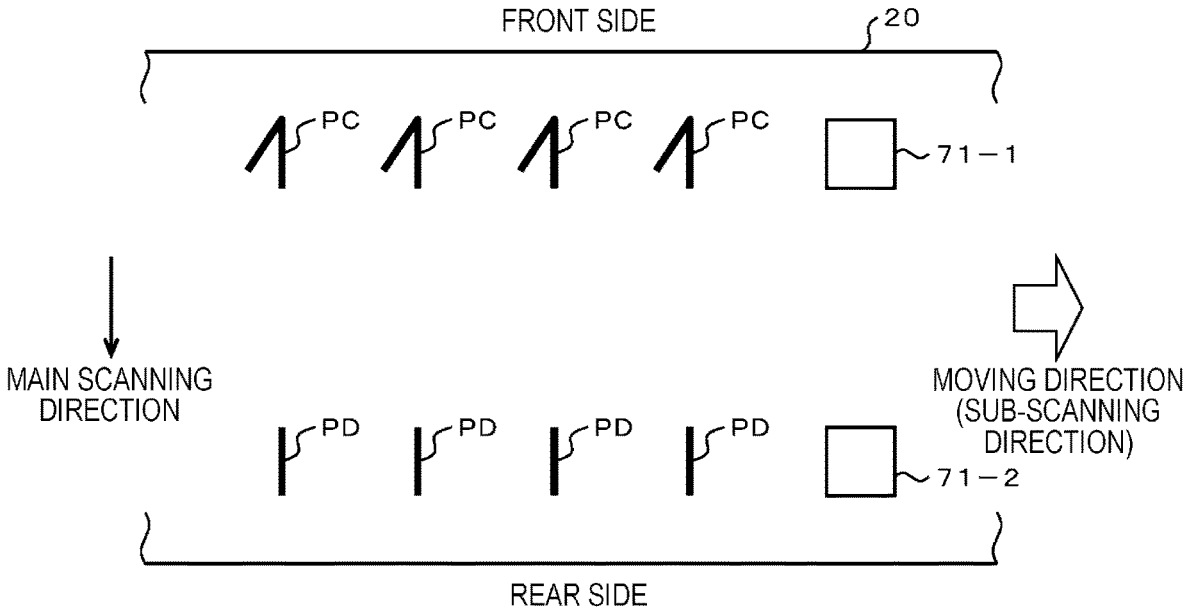
FIG. 10 is a diagram illustrating a state where a second check image in another example is formed on the image carrying surface of the belt 20.

FIG. 10 is a diagram illustrating a state where the second check image in another example is formed on the image carrying surface of the belt 20.

The second check image illustrated in FIG. 10 includes wedge patterns PC of the respective colors including yellow, magenta, cyan, and black are sequentially arranged to be spaced from each other in the sub-scanning direction. In addition, the second check image includes line patterns PD of the respective colors including yellow, magenta, cyan, and black are sequentially arranged to be spaced from each other in the sub-scanning direction. Among two line segments in one wedge pattern PC, a first line segment is a line that has a predetermined width in the sub-scanning direction and extends in the main scanning direction. The two line segments in one wedge pattern PC pass through the detection position of the toner sensor 71-1. The line pattern PD is a line that has a predetermined width in the sub-scanning direction and extends in the main scanning direction.

The processor 811 determines the line width of the front side based on the output voltage value of the toner sensor 71-1 if the first line segment in the wedge pattern PC passes through the detection position of the toner sensor 71-1. In addition, the processor 811 determines the line width of the rear side based on the output voltage value of the toner sensor 71-2 if the line pattern PD passes through the detection position of the toner sensor 71-2.

In another existing MFP or the like, the second check image illustrated in FIG. 10 is used as a pattern for detecting the formation status such as a difference between the image formation states of the respective colors. That is, if the MFP 100 is configured to detect this formation status, a check image for detecting the formation status can be used as the second check image.

The MFP 100 may further include a toner sensor configured to detect the toner attached to the image carrying surface of the photoreceptor in each of the image forming units 24-1 to 24-4 such that the abnormality is monitored as described above based on the detection result thereof.

The above-described embodiment is applicable to various apparatuses other than the MFP, for example, a copying machine, a printer, or a facsimile apparatus as long as an image can be formed using an electrophotographic method in the apparatuses.

The number of image forming units is not limited to four as long as at least one image forming unit is provided. If images formed by a plurality of image forming units do not overlap each other, for example, if one image forming unit is provided, the color misregistration abnormality is not monitored.

Three or more toner sensors may be provided such that the width and the position of the line pattern are measured and determined based on an output of each of the toner sensors. The various abnormalities can be monitored based on the results of the measurement and the determination.

Only one toner sensor may be provided.

In the above-described embodiment, a part or all of the respective functions that are implemented by the processor 811 through the information processing can also be implemented by hardware that executes information processing not based on a program, for example, a logic circuit. In addition, each of the respective functions can also be implemented by a combination of the hardware such as a logic circuit and a software control.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. An image forming apparatus, comprising:

an image carrier having an image carrying surface configured to move in a moving direction;

an image forming component configured to form an image on the image carrying surface with toner at a formation position;

a transfer component configured to transfer the image formed on the image carrying surface to a medium at a transfer position;

a detector configured to detect the toner attached to the image carrying surface at a detection position between the formation position and the transfer position;

a first controller configured to control the image forming component such that a first check image including a patch pattern and a line pattern that extends in a direction intersecting the moving direction is formed;

a relationship determination component configured to determine a correlation between a width of the line pattern and a density of an image to be formed by the image forming component based on a density of the patch pattern in the first check image and a width of the line pattern in the first check image;

a determination component configured to determine an allowable range of the width of the line pattern based on the correlation determined by the relationship determination component;

a second controller configured to control the image forming component such that a second check image including the line pattern is formed in a region that passes through the detection position in the image carrying surface;

a line width determination component configured to determine a width of the line pattern in the second check image based on a detection status of the toner by the detector if the line pattern in the second check image passes through the detection position; and a monitoring component configured to monitor a formation status of the image by the image forming component by comparing the width determined by the line width determination component and the allowable range determined by the determination component.

2. The image forming apparatus according to claim 1, wherein if the width determined by the line width determination component is outside the allowable range determined by the determination unit, the monitoring component determines that a formation density of the image by the image forming component requires correction.

3. The image forming apparatus according to claim 2, further comprising a correction component configured to correct the formation density of the image if the monitoring component determines that the formation density of the image requires correction.

4. The image forming apparatus according to claim 1, wherein if the width determined by the line width determination component is outside the allowable range determined by the determination component, the monitoring component determines that an abnormality occurs during the formation of the image by the image forming component.

5. The image forming apparatus according to claim 4, further comprising a processor configured to execute a predetermined process for counteracting the abnormality if the monitoring component determines that the abnormality occurs.

6. The image forming apparatus according to claim 1, wherein the determination component determines a first allowable range and a second allowable range that is narrower than the first allowable range, if the width determined by the line width determination component is outside the first allowable range determined by the determination component, the monitoring component determines that an abnormality occurs during the formation of the image by the image forming component, and if the width determined by the line width determination unit is outside the second allowable range determined by the determination component, the monitoring unit determines that a formation density of the image by the image forming component requires correction.

7. The image forming apparatus according to claim 1, wherein the first controller controls the image forming component such that the patch pattern and the line pattern are formed in the region that passes through the detection position in the image carrying surface, and the relationship determination component determines a correlation between a width of the line pattern and a density of an image to be formed by the image forming component based on a density of the patch pattern and a width, the density of the patch pattern being determined by the detector based on the detection status of the toner if the patch pattern passes through the detection position, and the width being determined by the detector based on the detection status of the toner if the line pattern passes through the detection position.

8. The image forming apparatus according to claim 1, further comprising a third controller configured to cause the first controller and the relationship determination component to execute the control of the image forming component, the determination of the correlation by the relationship determination component, and the determination of the allowable range by the determination component whenever a predetermined timing is reached.

9. The image forming apparatus according to claim 1, wherein a plurality of detectors are provided to detect the toner attached to the image carrying surface at each of different detection positions that are shifted from each other in the direction intersecting the moving direction, the second controller controls the image forming component such that the second check image including the line pattern is formed in a plurality of regions that pass through the detection positions in the image carrying surface, respectively, the line width determination component determines widths of the line patterns in the second check images based on detection statuses of the toner by the detectors if the line patterns in the second check images pass through the detection positions, respectively; and the monitoring component monitors a formation status of the image at each of the detection positions by the image forming component by comparing each of the widths determined by the line width determination component and the allowable range determined by the determination component.

10. The image forming apparatus according to claim 1, further comprising an output component configured to output a printing medium to which the first check image formed by the image forming component is transferred under the control of the first controller, wherein the relationship determination component determines a correlation between a width of the line pattern and a density of an image to be formed by the image forming component based on a density of the patch pattern in the first check image and a width of the line pattern in the first check image, the first check image being read by a document reading device from the printing medium output by the output component.

11. A method for an image forming apparatus, comprising:

moving an image carrying surface of an image carrier in a moving direction;

forming an image on the image carrying surface with toner at a formation position by an image forming component;

transferring the image formed on the image carrying surface to a medium at a transfer position by a transfer component;

detecting the toner attached to the image carrying surface at a detection position between the formation position and the transfer position by a detector;

controlling the image forming component such that a first check image including a patch pattern and a line pattern that extends in a direction intersecting the moving direction is formed by a first controller;

determining a correlation between a width of the line pattern and a density of an image to be formed by the image forming component based on a density of the patch pattern in the first check image and a width of the line pattern in the first check image by a relationship determination component;

determining an allowable range of the width of the line pattern based on the correlation determined by the relationship determination component by a determination component;

controlling the image forming component such that a second check image including the line pattern is formed in a region that passes through the detection position in the image carrying surface by a second controller;

determining a width of the line pattern in the second check image based on a detection status of the toner by the detector if the line pattern in the second check image passes through the detection position by a line width determination component; and monitoring a formation status of the image by the image forming component by comparing the width determined by the line width determination component and the allowable range determined by the determination component by a monitoring component.

12. The method according to claim 11, wherein if the width determined by the line width determination component is outside the allowable range determined by the determination unit, determining that a formation density of the image by the image forming component requires correction.

13. The method according to claim 12, further comprising:

correcting the formation density of the image if the monitoring component determines that the formation density of the image requires correction.

14. The method according to claim 11, wherein if the width determined by the line width determination component is outside the allowable range determined by the determination component, determining by the monitoring component that an abnormality occurs during the formation of the image by the image forming component requires correction.

15. The method according to claim 14, further comprising:

executing a predetermined process for counteracting the abnormality if the monitoring component determines that the abnormality occurs.

16. The method according to claim 11, further comprising:

determining a first allowable range and a second allowable range that is narrower than the first allowable range, if the width determined is outside the first allowable range determined, determining that an abnormality occurs during the formation of the image by the image forming component, and if the width determined is outside the second allowable range, determining that a formation density of the image by the image forming component requires correction.

17. The method according to claim 11, further comprising:

controlling the image forming component such that the patch pattern and the line pattern are formed in the region that passes through the detection position in the image carrying surface, and determining a correlation between a width of the line pattern and a density of an image to be formed by the image forming component based on a density of the patch pattern and a width, the density of the patch pattern being determined by the detector based on the detection status of the toner if the patch pattern passes through the detection position, and the width being determined by the detector based on the detection status of the toner if the line pattern passes through the detection position.

18. The method according to claim 11, further comprising:

causing the first controller and the relationship determination component to execute the control of the image forming component, the determination of the correlation by the relationship determination component, and the determination of the allowable range by the determination component whenever a predetermined timing is reached.

19. The method according to claim 11, further comprising:

detecting, by a plurality of detectors, the toner attached to the image carrying surface at each of different detection positions that are shifted from each other in the direction intersecting the moving direction, controlling the image forming component such that a second check image including the line pattern is formed in a plurality of regions that pass through the detection positions in the image carrying surface, respectively, determining widths of the line patterns in the second check images based on detection statuses of the toner by the detectors if the line patterns in the second check images pass through the detection positions, respectively; and monitoring a formation status of the image at each of the detection positions by the image forming component by comparing each of the widths determined by the line width determination component and the allowable range determined by the determination component.

20. The method according to claim 11, further comprising:

outputting a printing medium to which the first check image formed by the image forming component is transferred under the control of the first controller, and determining a correlation between a width of the line pattern and a density of an image to be formed by the image forming component based on a density of the patch pattern in the first check image and a width of the line pattern in the first check image, the first check image being read by a document reading device from the printing medium output by output component.

* * * * *